US009295315B2

(12) United States Patent
Kloeppel-Riech et al.

(10) Patent No.: US 9,295,315 B2
(45) Date of Patent: Mar. 29, 2016

(54) HAIR CARE APPLIANCE WHICH CAN BE EMPLOYED IN A FLEXIBLE MANNER

(75) Inventors: Michael Kloeppel-Riech, Friedberg (DE); Katja Honnefeller, Friedrichsdorf (DE); Norbert Smetana, Frankfurt/Main (DE); Olaf Soerensen, Mainz (DE); Juergen Seng, Kelkheim (DE)

(73) Assignee: Braun GmbH, Kronberg (DE)

( * ) Notice: Subject to any disclaimer, the term of this patent is extended or adjusted under 35 U.S.C. 154(b) by 1015 days.

(21) Appl. No.: 12/674,053

(22) PCT Filed: Jul. 25, 2008

(86) PCT No.: PCT/EP2008/006123

§ 371 (c)(1),
(2), (4) Date: Mar. 2, 2010

(87) PCT Pub. No.: WO2009/015829

PCT Pub. Date: Feb. 5, 2009

(65) Prior Publication Data

US 2011/0088714 A1 Apr. 21, 2011

(30) Foreign Application Priority Data

Jul. 27, 2007 (DE) ..... 10 2007 035 247

(51) Int. Cl.
*A46B 15/00* (2006.01)
*A45D 20/12* (2006.01)
(Continued)

(52) U.S. Cl.
CPC ..... *A45D 20/12* (2013.01); *A45D 20/50* (2013.01); *A45D 20/525* (2013.01);
(Continued)

(58) Field of Classification Search
CPC ..... A46B 15/0024; A46B 2200/104; A45D 2200/202
USPC ..... 132/115, 126, 148, 157, 212, 219, 221, 132/271, 272; 15/160, 169, 184, 185, 246
See application file for complete search history.

(56) References Cited

U.S. PATENT DOCUMENTS 2,397,757 A * 4/1946 Herve ..... 607/79
2,607,064 A * 8/1952 Sullivan et al. ..... 15/187
(Continued)

FOREIGN PATENT DOCUMENTS

JP 2004/344354 A 12/2004

OTHER PUBLICATIONS

European International Search Report dated Dec. 16, 2008, 2 pages.
(Continued)

*Primary Examiner* — Robyn Doan
*Assistant Examiner* — Tatiana Nobrega
(74) *Attorney, Agent, or Firm* — Jerry J Yetter; Jeffrey V Bamber; James C Vago

(57) ABSTRACT

The present invention relates to a hair treatment appliance (1) having a handle (3), a functional head (4) which can be connected to the handle (3) and has a hair treatment device (5), and also an ion application device (9) for applying ions to the hair, said ion application device having at least one ion outlet (11), wherein the functional head (4) and the handle (3) also in each case have an electrically conductive area on an outer face of the component and the electrically conductive area of the functional head (4) and the electrically conductive area of the handle (3) are electrically conductively connected to one another.

1 Claim, 9 Drawing Sheets

Figure 1:
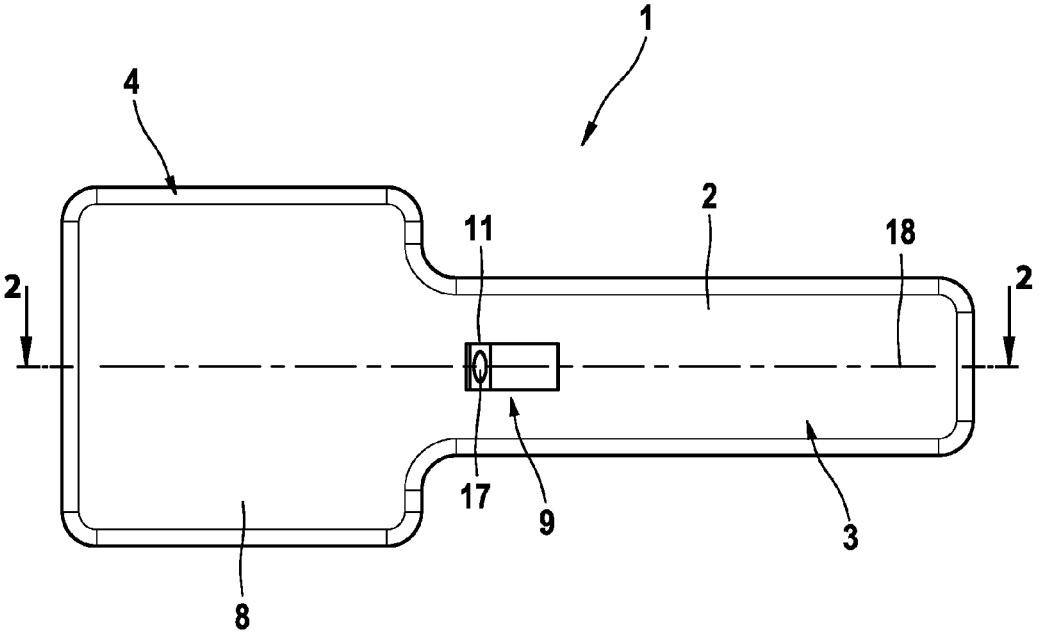

(51) Int. Cl.

| | |
|---|---|
| ***A45D 20/50*** | (2006.01) |
| ***A45D 20/52*** | (2006.01) |
| *A45D 1/04* | (2006.01) |
| *A45D 20/10* | (2006.01) |

(52) U.S. Cl.

CPC ..... *A46B 15/0002* (2013.01); *A46B 15/0024* (2013.01); *A45D 1/04* (2013.01); *A45D 20/10* (2013.01); *A45D 2200/202* (2013.01); *A46B 2200/104* (2013.01)

(56) References Cited

U.S. PATENT DOCUMENTS

| | | | | |
|---|---|---|---|---|
| 4,797,966 | A * | 1/1989 | Fong | 15/186 |
| 5,150,491 | A * | 9/1992 | Ikemoto | 15/1.52 |
| 5,622,192 | A * | 4/1997 | Chiou | 132/112 |
| 6,029,307 | A * | 2/2000 | Baudoin | 15/145 |
| 6,536,065 | B2 * | 3/2003 | Forrest | 15/22.1 |
| 7,287,532 | B2 * | 10/2007 | Hafemann | 132/232 |
| 7,992,578 | B2 * | 8/2011 | Tobias et al. | 132/225 |
| 2002/0062836 | A1 * | 5/2002 | Saida et al. | 132/271 |
| 2002/0078902 | A1 * | 6/2002 | Ehrmann | 119/625 |
| 2002/0100488 | A1 * | 8/2002 | Taylor et al. | 132/271 |
| 2004/0129288 | A1 * | 7/2004 | Saida et al. | 132/228 |
| 2005/0016559 | A1 * | 1/2005 | Saida et al. | 132/271 |
| 2005/0172979 | A1 * | 8/2005 | Saida et al. | 132/228 |
| 2005/0284495 | A1 * | 12/2005 | Yasuda et al. | 132/272 |
| 2008/0040878 | A1 * | 2/2008 | Choi et al. | 15/184 |
| 2009/0050169 | A1 * | 2/2009 | Ma et al. | 132/115 |
| 2009/0241975 | A1 * | 10/2009 | Nakakura | 132/120 |
| 2010/0147324 | A1 * | 6/2010 | Hafemann | 132/226 |
| 2010/0263223 | A1 * | 10/2010 | Wynne | 34/97 |
| 2010/0269849 | A1 * | 10/2010 | Ishikawa et al. | 132/271 |
| 2011/0005539 | A1 | 1/2011 | Honnefeller et al. | |
| 2011/0088275 | A1 | 4/2011 | Kloeppel-Riech et al. | |
| 2011/0094528 | A1 * | 4/2011 | Leung | 132/120 |
| 2011/0094535 | A1 | 4/2011 | Honnefeller et al. | |
| 2011/0315158 | A1 | 12/2011 | Kloeppel-Riech et al. | |

OTHER PUBLICATIONS

All Office Actions, U.S. Appl. No. 12/674,051.
All Office Actions, U.S. Appl. No. 12/669,915.
All Office Actions, U.S. Appl. No. 12/674,732.
All Office Actions, U.S. Appl. No. 12/673,981.

* cited by examiner

HAIR CARE APPLIANCE WHICH CAN BE EMPLOYED IN A FLEXIBLE MANNER

Hair care appliance which can be employed in a flexible manner.

The present invention relates to a hair care or hair treatment device having a handle, a function head that can be connected to the handle and that has a hair treatment device, in particular a bristle and/or tooth field, and an ion-discharging device for discharging ions onto the hair having at least one ion outlet.

Recently, hair care devices, in particular hairbrushes, have become known that in addition to their primary function—in the case of a hairbrush, the combing, brushing, and styling of the hair—discharge ions as an additional application. Such ions are usually molecules charged with negative electrons. With the aid of such an ion application, the hair and hair care can be improved; in particular, a static charge on the hair and causing it to stand up can be avoided.

From US 2005/284495, a hair brush or hair dryer is known having an integrated brush attachment that has an ion outlet on a device back side, facing away from the bristle field, and on a device front side, bearing the bristle field, said outlets allowing ions to exit in the direction of the function head.

In such hair care devices having ion application, on the one hand, the ions should of course be discharged onto the hair in a targeted fashion, while on the other hand, the charging of the hair should not be concentrated in certain spots, but should be distributed as uniformly as possible. Here, the ion discharge is hindered not only by direct mechanical obstacles such as hair coming in front of the ion outlet, or the hand of the user getting in the way, but also by electrostatic counter-fields that can emanate from highly negatively charged components, which repel the negatively charged ions so to speak, or components having high positive charges, which have an attractive field-effect on the ions. Such charges can, for example, arise at the bristle field itself when the hair is brushed with it. In the area of the ion outlet, electrostatic fields can also form on the device housing, which can hinder the exit of the ions.

A further aspect that is to be improved in known hair care devices of the type named above is user safety, which can be impaired by the above-named strong charges at the device. Moreover, the device should enable various types of hair treatment, while being able to be held in different ways, while nonetheless always functioning efficiently and safely.

In line with this, the present invention is based on the object of creating an improved hair care device of the type named above that avoids the disadvantages of the prior art and further develops the prior art in an advantageous manner. In particular, using simple means, a uniform, efficient discharge of ions onto the hair is to be achieved without impairing the flexibility of use and the user safety of the device.

According to the invention, this object is achieved by a hair care device according to claim 1. Preferred embodiments of the invention are the subject matter of the dependent claims.

Thus, it is proposed that the function head and the handle should each have an electrically conductive surface on the outside of a component, and the electrically conductive surface of the function head and the electrically conductive surface of the handle should be connected to one another in an electrically conductive fashion. These electrically conductive surfaces take on the electrical potential of the user of the hair treatment device. Having this potential available at the hair treatment device permits a more efficient handling of the hair.

For example, in this way suitable countermeasures can be used to remove an electrostatic charge and counter-fields at least on those parts of the hair care device standing in the way of the discharge of ions onto the hair or impairing the ion discharge. Without impairment by such electrostatic counter-fields, a uniformly distributed but nonetheless targeted and efficient ion charging of the hair can be achieved even using a simple design of the ion discharge device, which, in a simple embodiment of the invention, can make do with only a single ion outlet.

In principle, the electrically conductive surface can be fashioned in various ways. In particular, the grounding surface can be fashioned as a metallic surface attached to a non-conductive body or housing component of the function head and/or of the ion outlet, preferably made of plastic. The body of the function part or of the ion outlet itself can in addition be fashioned as a plastic injection-molded part or as a plastic part manufactured in some other way.

With regard to the arrangement of the electrically conductive surfaces, various embodiments may be advantageous. On the function head, an advantageous arrangement may be to attach the electrically conductive surface to the hair treatment device, in particular to the bristle and/or tooth field. For example, the electrically conductive surface may form the bed, so to speak, bearing the bristles or teeth of the bristle field, or bearing the processing tool, which may also optionally be other treatment tools for the hair treatment device, designed differently. Alternatively or in addition to the above-named bristle and/or tooth field, the hair treatment device may, for example, also have a processing surface made of a material suitable for hair care, such as ceramic. Alternatively or in addition, a heating surface of a suitable shape may be provided, in particular a smooth, concave, and/or convexly curved processing surface.

Alternatively, or in addition to the above-named embodiment in which the electrically conductive surfaces are connected directly to the hair treatment device, at least the electrically conductive surface on the function head can also surround at least segments of the periphery of the hair treatment device, preferably annularly, and/or can be positioned immediately adjacent to the hair treatment device. In particular, a metallic strip can be provided as an electrically conductive surface around the hair treatment device on the function head. Here, the hair treatment device itself, i.e. for example the bristle and/or tooth field, or the housing body of the function head, can itself be made of non-conductive material. Advantageously, the electrically conductive surface on the function head is not provided in the immediate vicinity of the at least one ion outlet.

The electrically conductive surface advantageously can be situated on the edge next to the hair treatment device in the function head bearing the hair processing device. For example, the function head can have a body (which can be completely or partially non-conductive) having at least two side surfaces opposite one another, and each of the two side surfaces can have an electrically conductive surface. Alternatively or in addition, at least one additional, i.e. third, side surface can also have an electrically conductive surface. For example, the front surface of the body can have an electrically conductive surface.

Within the scope of the invention, the handle of the hair care device is intended to have an electrically conductive surface. This can also serve to conduct positive charges to the user of the hair care device. In this way, the user is protected from becoming charged. That is to say, the emission of negative ions can negatively charge the user. Through the contact surface on the handle, on the other hand, positive charges can be transferred to the user, compensating for the charging effect from the negative ions. This is advantageous in particular in an embodiment of the hair care device that does not have a mains connection, in particular an embodiment as a battery device and/or accumulator device. In such a non-mains device, the generation of the negative ions standardly also causes an equivalent degree of positive charge at the device, because the device, as a battery or accumulator device, lacks reference potential. Due to this positive charge at the device, a negative charging of the user can be compensated via the above-named electrically effective contact surface on the handle.

The electrically conductive surface of the handle and the electrically conductive surface of the function head can be electrically conductively connected to one another in any fashion. For example, the connection may be via a conductor formed as a metallic strip, a wire, or a stranded wire. The connection in each case can take place via a conductor that runs completely or partly on the external sides, on the inside or in the interior of components. For example, the electrically conductive surface of the function head and the electrically conductive surface of the handle can be electrically conductively connected via a conductor, and this conductor can run on the outside of the component of the function head and/or on the outside of the component of the handle. Alternatively, the electrically conductive surface of the function head and the electrically conductive surface of the handle can be electrically conductively connected via a conductor, and this conductor can run on the inside of the component and/or in the interior of the component of the function head and/or on the inside of the component and/or in the interior of the component of the handle. In particular, the conductor can be routed completely in the interior of the component.

The electrically conductive surface can also act as a grounding surface. The electrical potential of the user of the device then defines the grounding potential for the hair treatment device. Providing further grounding points on the hair treatment device can increase its efficiency.

The electrical grounding of the housing component over which the ion cloud is dispersed advantageously does not take place in the field of view of the ion cloud, but rather on a housing component side facing away from the ion outlet, in particular on an inner surface of the housing component.

According to an advantageous development of the invention, the device housing can be provided with an ion-guiding device or ion-controlling device in an area over which the ion cloud exiting from the ion outlet disperses, and/or in the vicinity of the ion outlet. Here, control of the ions can be achieved advantageously in that a plurality of separate housing components are provided in the vicinity of the ion outlet, of which at least one is grounded and at least one further one is ungrounded. While the ungrounded housing part becomes electrically charged and thus can deflect the ions, the ions can spread out unhindered over the grounded housing components, so that, with a suitable pattern of grounded and ungrounded housing components the distribution of the exiting ions can be appropriately controlled.

Depending on the particular application, such an ion-guiding device can be fashioned in various ways to produce different distribution patterns. In a preferred embodiment of the invention, a pattern of grounded and ungrounded housing components can be provided in the vicinity of the ion outlet symmetrically around the longitudinal plane of the device, resulting in an overall symmetrical ion distribution. However, alternatively, to create a device intended for right-handed users or for left-handed users, for example, configurations are possible different from this symmetry relative to the longitudinal plane.

Due to the largely unimpaired ion discharge onto the hair achieved by the grounding surfaces and the charge fields on the device which are thereby removed or restricted, a particularly simple design of the ion discharge device can be achieved, in particular with regard to the arrangement of the ion outlet. In one embodiment of the invention in particular, the ions are emitted exclusively on the back of the device, facing away from the hair treatment device performing the primary function of the hair care device. Surprisingly, in this way an evenly distributed and nonetheless targeted ion discharge can be directed onto the hair. Until now, it was standardly sought to discharge at least a portion of the ions at the front of the device in the area of the hair care device, in order to bring the ions directly into the area to be treated, so to speak, because it was assumed that ions discharged at the back of the device would more or less miss the target, i.e. the hair to be cared for. In particular in connection with the above-described grounding surfaces and the removal or restriction of bothersome charge fields, discharging ions on the back of the device can result in a particularly uniform distribution, yet in a nearly complete discharge of the ions onto the hair, because the hair usually has a positive charge which attracts ions to compensate for the discharged ions. If no stronger disturbing fields are present at the hair care device to hinder ion discharge, this effect is sufficient. By positioning the ion outlet, or of all the ion outlets, on the back side of the device, the ion discharge takes place without mechanical interference from the user's hand or from strands of hair in front of the ion outlet.

In principle, a single ion outlet can be sufficient. If warranted, it is also possible to situate a plurality of ion outlets on the back side of the device. In both cases, the arrangement is preferably made symmetrical to the longitudinal plane of the hair care device. Preferably, the at least one ion outlet, or the plurality of ion outlets, are positioned in such a way that a main exit direction of the ions, or the sum of the main exit directions of the ions, is toward the plane of the back surface, or over the surface of the back symmetrical to the longitudinal plane. In this way, the main exit direction of the ion outlet is advantageously aligned essentially parallel to the back surface, so that the ions exit out over this, essentially parallel to the back side of the device. Alternatively or in addition, ions can be emitted at a slightly acute angle (upward). Here, the ion discharge can be inclined to the surface of the back side at an angle of preferably 0° to 45°, preferably 0° to 30°.

To achieve a uniform distribution of ions onto the hair, the at least one ion outlet is situated at the edge of the back surface of the device opposite the hair treatment device, so that an ion cloud forms over the back side of the function head.

If only a single ion outlet is present, this outlet is advantageously situated in the longitudinal plane itself. In the case of two ion outlets on the back side of the device, these can be situated so that they are at the same level relative to one another from the longitudinal plane, and preferably both can be inclined slightly in toward the longitudinal midplane. Alternatively, given two ion outlets on the back side of the device, they can be positioned opposite one another such that the two ion outlets are situated on opposite edges of the back surface of the function head and are directed toward one another so that the ions exit toward one another, so to speak.

The hair treatment device can be securely mounted to the function head, and can also be permanently integrated into the function head. Alternatively, the hair treatment device can advantageously be interchangeably attached to the function head, so that a function head can be connected to and used with various hair treatment devices. In addition to a bristle or tooth field, other hair treatment devices are also possible, including, for example: a heat treatment device, a heatable hair straightener, a warm air device, for example in the form of a hair dryer or a hot air brush. As a rule, such different hair treatment devices require different types of handling and ways of holding the device, so that it is advantageous to offer electrically conductive surfaces in the disclosed manner. Moreover, the stream of ions should be emitted in such a way that both its strength and its geometric distribution are compatible with a large number of function heads.

These and further features of the invention based on the claims and also on the following description and/or on the accompanying drawings, wherein the features can form the subject matter of the invention in various combinations and sub-combinations with one another, as well as individually, without regard to their summary in the claims. In the following, the invention is explained in more detail on the basis of preferred exemplary embodiments and accompanying drawings.

Figure 2:
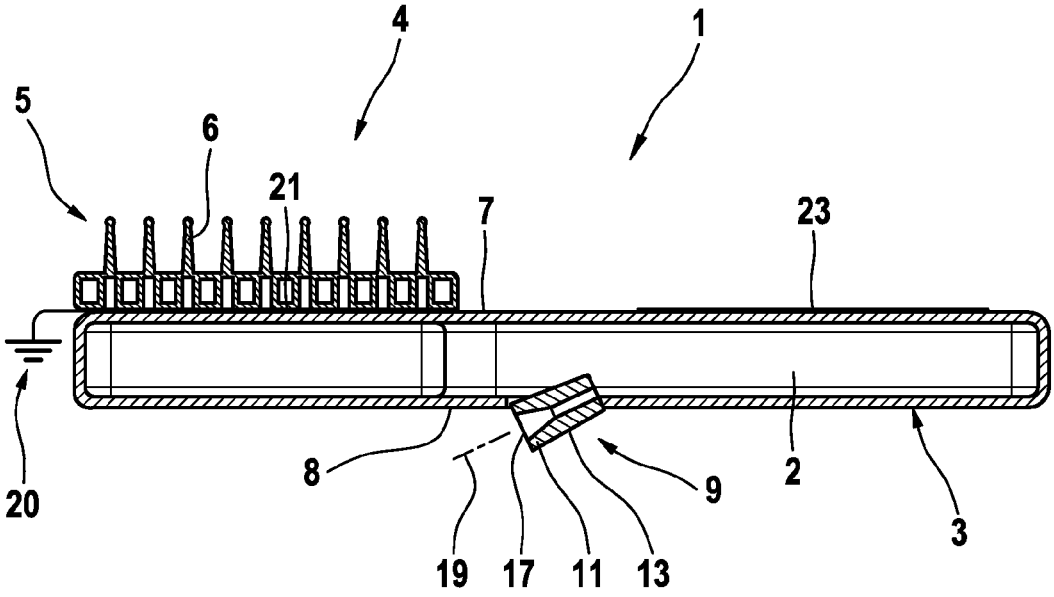
Figure 3:
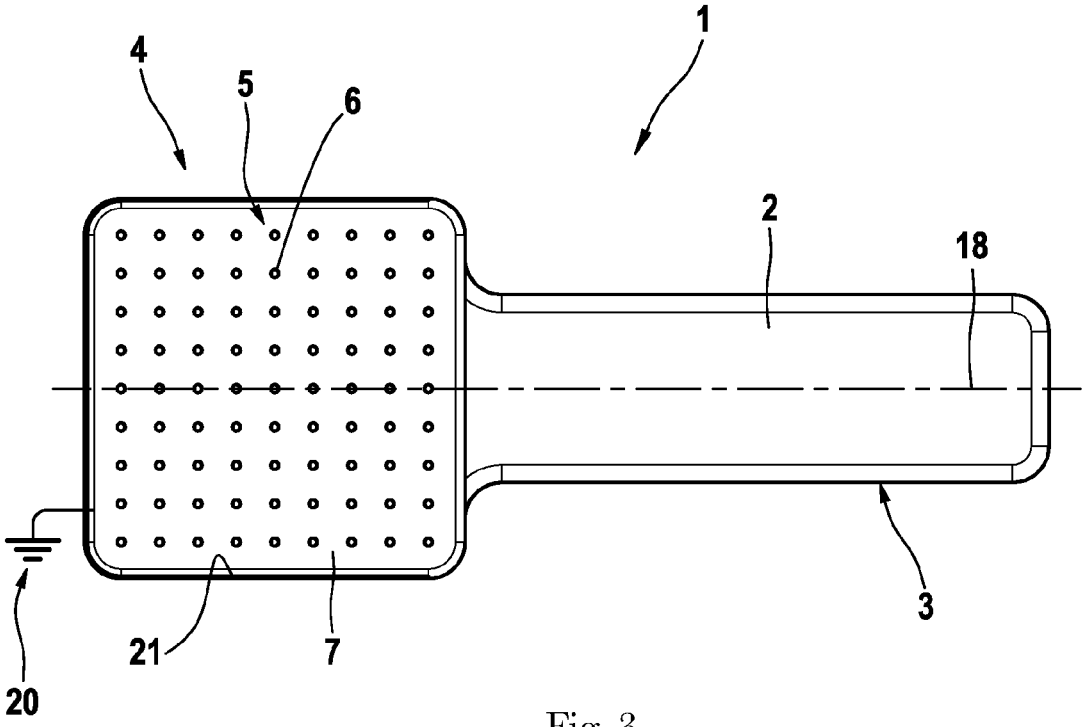
Figure 4:
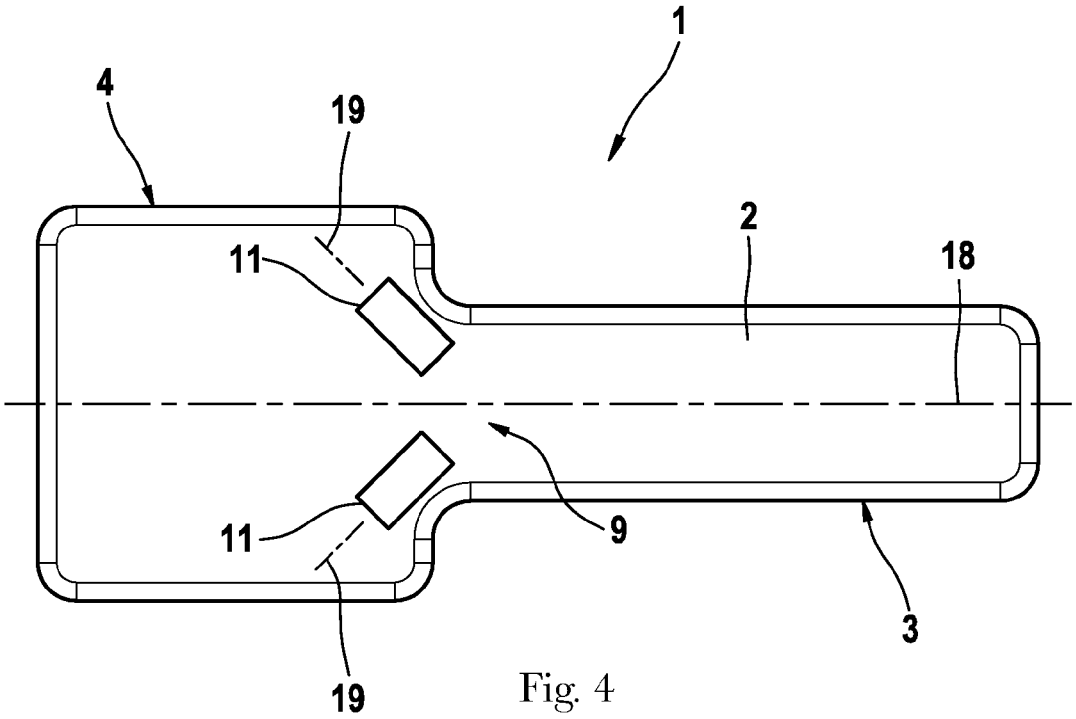
Figure 5:
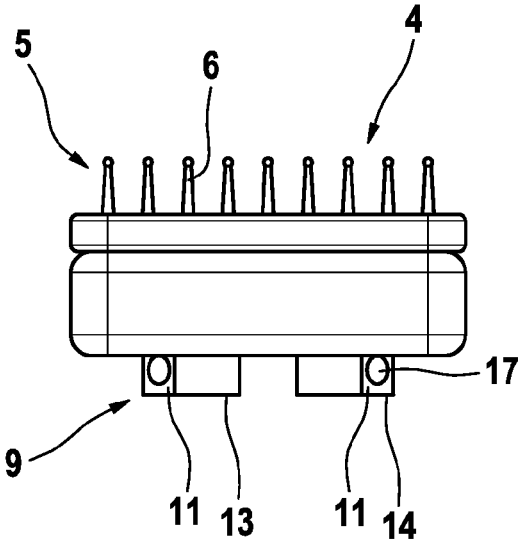
Figure 6:
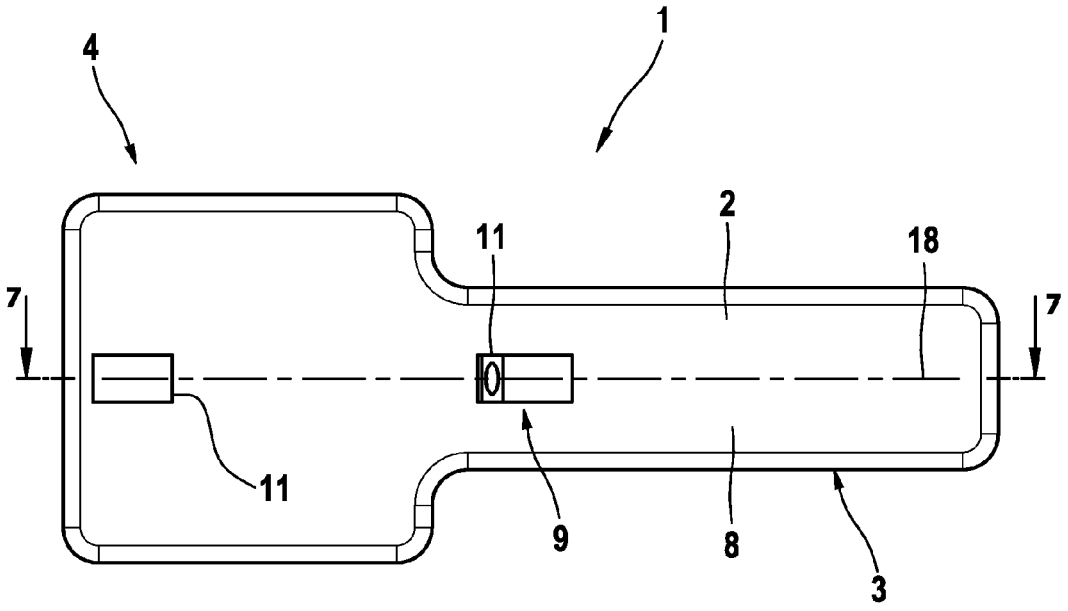
Figure 7:
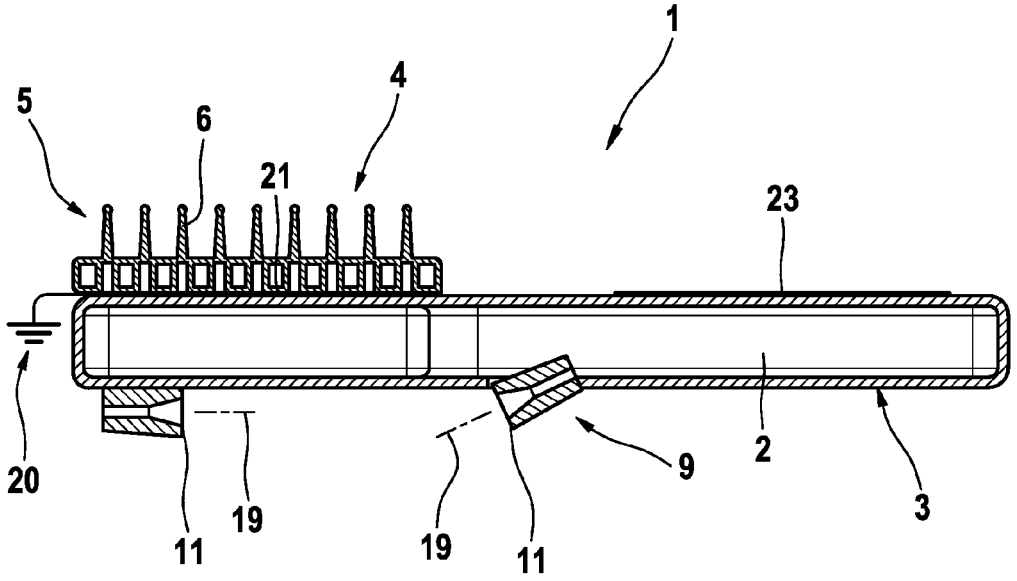
Figure 8:
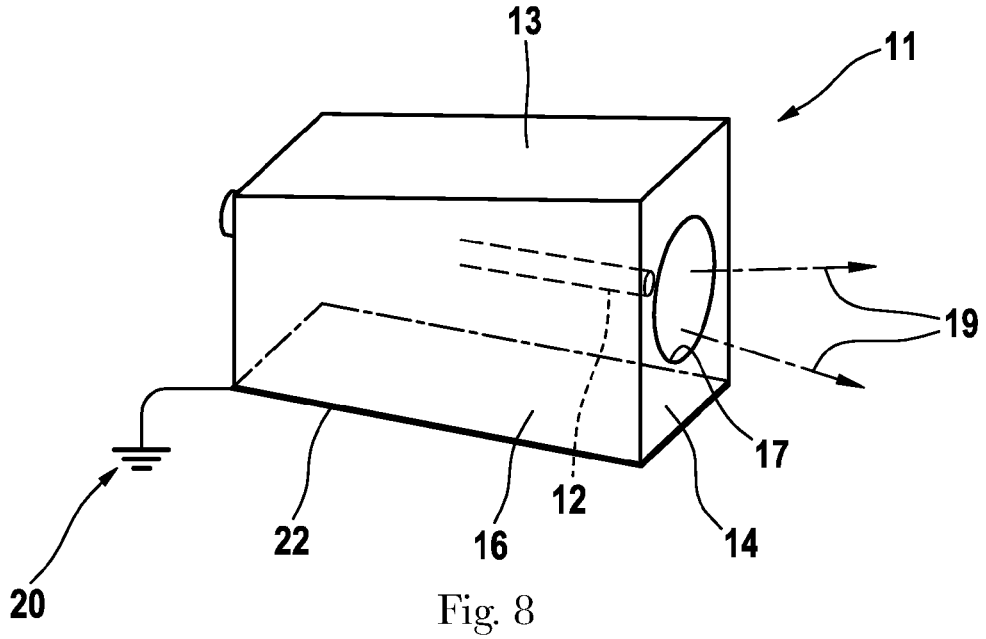
Figure 9:
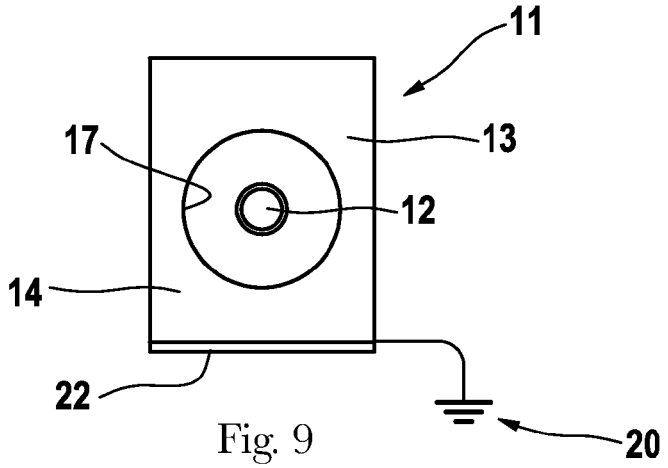
Figure 10:
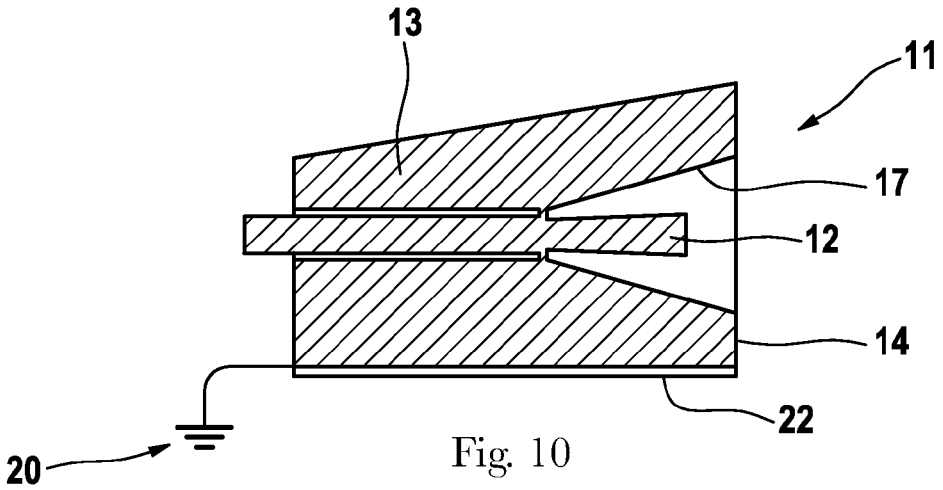
Figure 11:
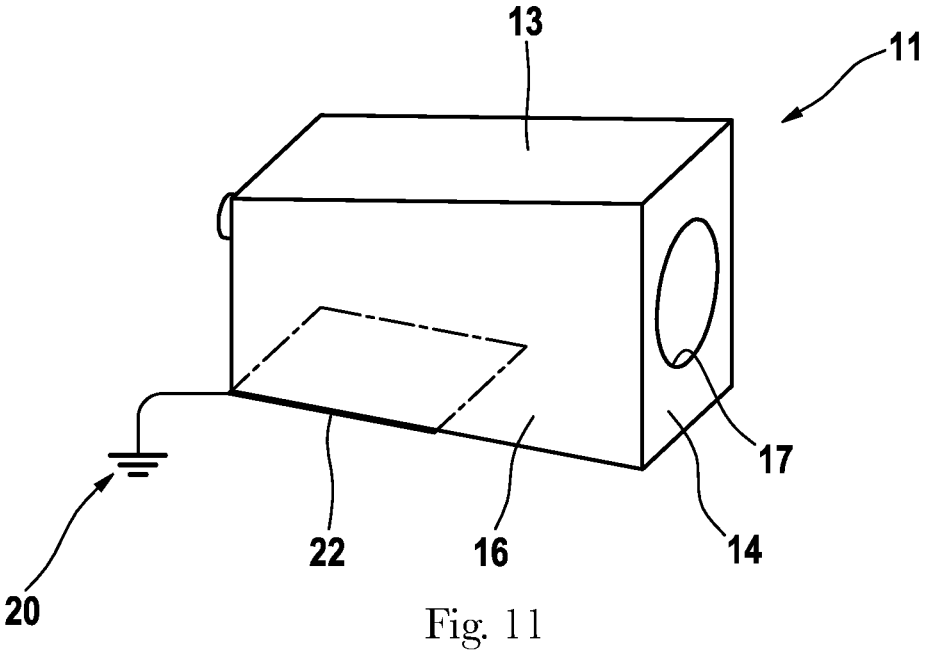
Figure 12:
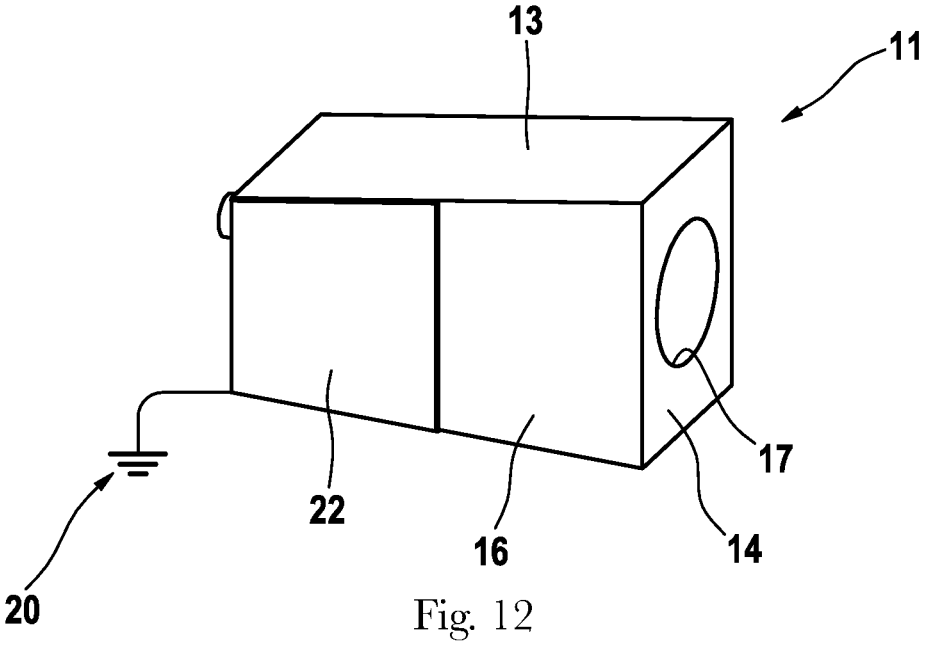
Figure 13:
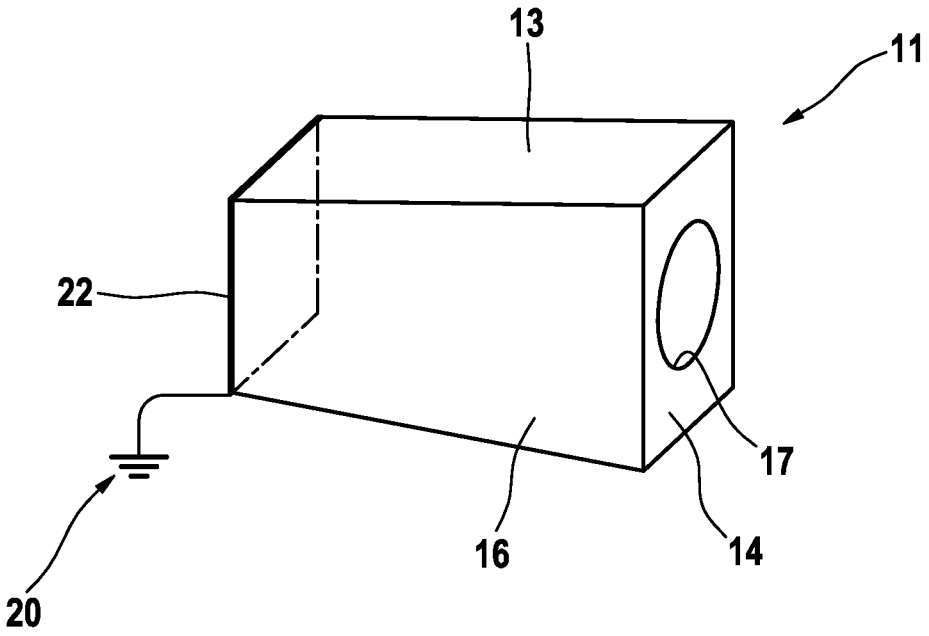
Figure 14:
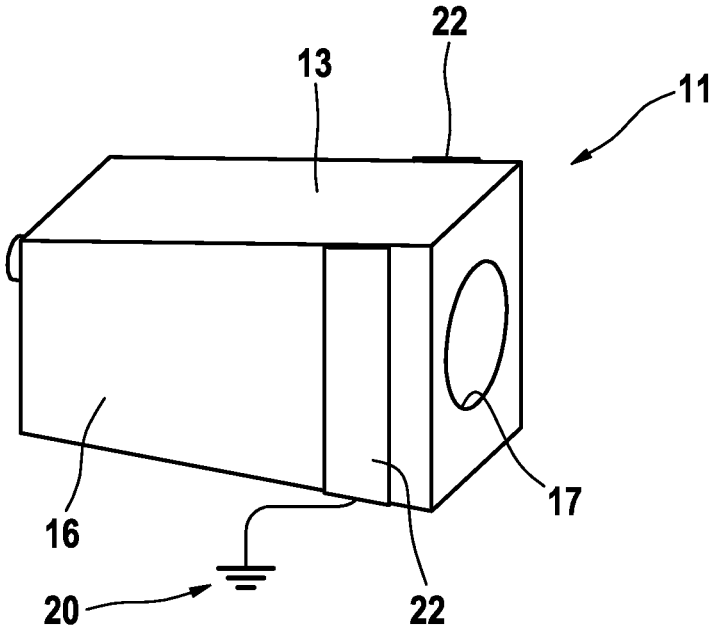
Figure 15:
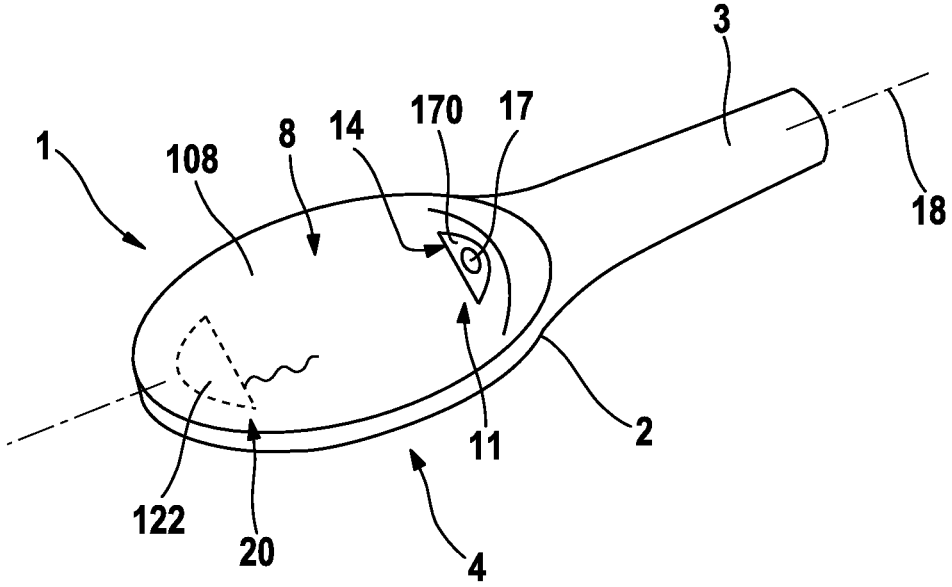
Figure 16:
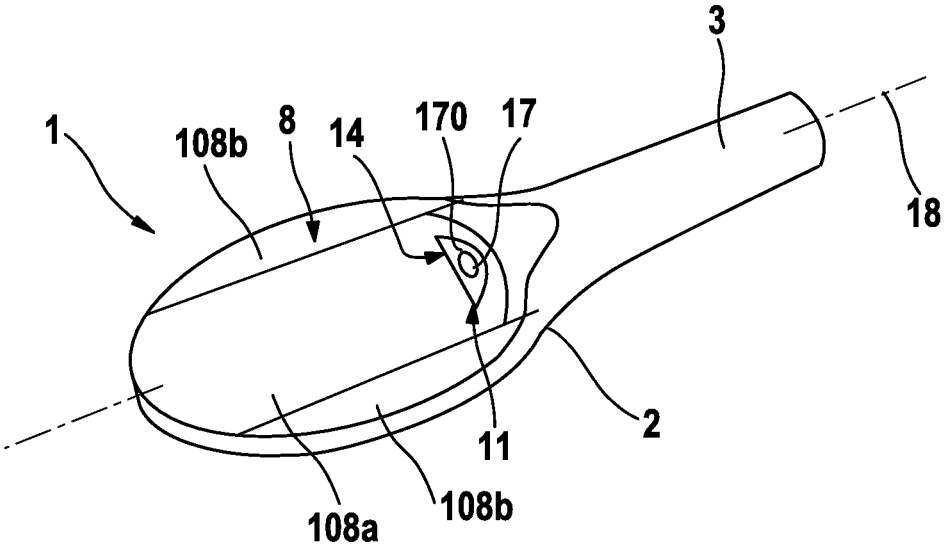

FIG. 1 shows a top view of the back side of a hair care device in the form of a hair brush according to an advantageous embodiment of the invention that shows the ion outlet in the longitudinal plane on the edge of the back side of the function head, FIG. 2 shows a longitudinal section through the hair brush of FIG. 1 along the line A-A in FIG. 1, wherein an electrically conductive surface is provided on the function head under the tooth field provided there, FIG. 3 shows a top view of the front side of a hair brush according to a further advantageous embodiment of the invention, in which the electrically conductive surface on the function head is provided as a metallic strip that surrounds the tooth field at the edge, FIG. 4 shows a top view of the back side of a hair brush according to a further advantageous embodiment of the invention, showing the arrangement of two ion outlets on the edge of the back of the function head symmetrical to the longitudinal plane, FIG. 5 shows a frontal view of the hair brush of FIG. 4, showing the main exit directions of the ion outlets, angled away from one another and running essentially parallel to the back side surface of the hair brush, FIG. 6 shows a top view of the back side of a hair brush according to a further advantageous embodiment of the invention, in which two ion outlets are arranged in the longitudinal plane of the hair brush, directed opposite one another, FIG. 7 shows a longitudinal section of the hair brush along the line A-A in FIG. 6, showing the differing inclination of the ion outlets on the back side of the hair brush, FIG. 8 shows a schematic perspective view of the ion outlet and its outlet housing according to an advantageous embodiment of the invention in which a bottom surface of the outlet housing is fashioned as a grounding surface, FIG. 9 shows a frontal top view of the orifice side of the ion outlet of FIG. 8, FIG. 10 shows a longitudinal section through the ion outlet of the two preceding figures, FIG. 11 shows a perspective schematic representation of an ion outlet according to an alternative advantageous embodiment of the invention, in which only a partial area of the bottom side of the outlet housing is fashioned as a grounding surface, FIG. 12 shows a schematic perspective representation of an ion outlet according to a further advantageous embodiment of the invention, in which a side surface of the outlet housing is fashioned partly as a grounding surface, FIG. 13 shows a schematic perspective view of an ion outlet according to a further advantageous embodiment of the invention, in which a back side of the outlet housing, opposite the orifice side, is fashioned as a grounding surface, FIG. 14 shows a schematic perspective representation of an ion outlet according to a further advantageous embodiment of the invention in which two opposed side surfaces of the outlet housing are each partly fashioned as grounding surfaces, FIG. 15 shows a schematic perspective representation of a hair care device in the form of a hair brush, according to a further advantageous embodiment of the invention, having an ion outlet on a back side of the hair brush, wherein the housing component of the device is grounded in the vicinity of the ion outlet, and FIG. 16 shows a schematic perspective representation of a hair care device similar to FIG. 15, wherein a plurality of separate housing components are provided in the vicinity of the ion outlet on the back side of the device, of which only one is grounded, and the others are ungrounded.

Hair care device 1 shown in FIGS. 1 and 2 comprises a main body of the device 2 that has a handle 3 and that has electronic devices, to be described below, in its interior or on its outer shell. Said handle 3 bears a function head 4 that bears a bristle field 6 as hair treatment device 5 on the front side of the device 7. However, it is to be understood that other hair treatment tools, such as for example heating rods or hair styling elements, or possibly also a blower outlet, can also be provided if the hair care device is fashioned as a hair styling device and/or as a hair dryer. Said hair treatment tools can optionally also be combined with one another.

Advantageously, hair care device 1 can have a modular design with several interchangeable components, wherein in particular the entire function head 4, and/or hair treatment device 5, can be fashioned separate from the main body of the device 2, in said manner. Here, positively fitting connections can advantageously be provided between the various components, for example as snap-in tongues and recesses, enabling the components to be removed and reinstalled without tools.

As FIGS. 1 and 2 show, in addition an ion discharge device 9 is provided on the main body of the device 2, on its back side 8 facing away from hair treatment device 5, said discharge device having an ion emitter situated in the interior of the main body of the device 2 and/or that can have a high-voltage element 12, situated in ion outlet 11, to emit the ions. Said high-voltage element 12 can be situated in a box-type or jacket-type outlet housing 13 whose wall has an exit opening 17 on an orifice side 14 through which the emitted ions can exit.

In the embodiment depicted, ion outlet 11 is fashioned as a nozzle or diffuser, and causes a directed exiting of ions; cf. FIG. 2. Advantageously, ion outlet 11 is positioned on the back side of the device 8, opposite bristle field 6, or faces away therefrom and forms the back of the hair brush, so to speak. Advantageously, ion outlet 11 is situated in longitudinal plane 18, which forms the plane of projection of FIG. 2, wherein advantageously, main exit direction 19 of ion outlet 11 is inclined at a slightly acute angle to the surface of the back side of the device and is oriented away therefrom; cf. FIG. 2, wherein the angle of inclination is advantageously between 0° and 45°, and in the embodiment depicted, can advantageously be between approximately 20° and 30°. As FIGS. 1 and 2 show, ion outlet 11 is situated on the edge of the back side surface of the function head, said back side surface being situated opposite bristle field 6, so that the ions exiting from ion outlet 11 form an ion cloud over the back side of function head 4. In particular, ion outlet 11 can, as FIG. 1 shows, be situated approximately, roughly speaking, in the area of transition between handle 3 and function head 4.

In the interior of the main body of the device 2, a power supply unit is housed, not specifically shown, which can preferably be fashioned as a battery device or accumulator device. Advantageously, hair care device 1 is fashioned so as to be energy self-sufficient; i.e., it does not have a permanent power adaptor to supply power from an electric outlet. Of course, a power cord can be plugged in, in order to charge the accumulators inside the main body of the device 2. Ion discharge device 9 is powered by said power supply to generate ions.

As FIG. 2 shows, in one embodiment, hair care device 1 is advantageously provided with a grounding device 20 to prevent unwanted charging of the device, to prevent interference with the exiting of ions, and to improve the operational safety of the device. In the depicted embodiment according to FIG. 2, function head 4 has an electrically conductive surface 21 that can prevent the buildup of large charge fields in the area of function head 4, in particular in the area of hair treatment device 5. In the embodiment according to FIG. 2, electrically conductive surface 21 is directly connected to hair treatment device 5, wherein the electrically conductive surface is fashioned as a carrier and is seated under hair treatment device 5, which is fastened thereto. Here, electrically conductive surface 21 is advantageously made of a metallic surface and/or a metallic coating attached to the function head body, which is otherwise made of plastic. Electrically conductive surface 21 can be connected to the ground potential of the voltage circuit, e.g. via ground components situated inside the device. The connection of the electrically conductive surface (21) to the grounding device is optional, regardless of the fact that such connection is illustrated.

A further electrically conductive surface 23 is provided on the handle of the device. Electrically conductive surface 23 is also advantageously made up of a metallic surface and/or a metallic coating applied on the handle, which is otherwise made of plastic.

Alternatively, or in addition, electrically conductive surface 21 on the function head side can also have a body with a metallic surface on the edge of bristle field 6, preferably as a metallic strip surrounding bristle field 6 annularly, or, as shown in FIG. 3, enclosing it on three sides in a U-shape. Bristle field 6 and the rest of the body of function head 4 can be fashioned so as to be non-conductive, in particular made of plastic. In the case of an electrically conductive surface 21 on the edge of bristle field 6 according to FIG. 3, electrically conductive surface 21 surrounds a large enough portion of bristle field 6 to compensate, to a sufficient degree, charges that arise there. Advantageously, the metallic strip will extend along at least 50% of the periphery of hair treatment device 5. The connection of the electrically conductive surface (21) to the grounding device is optional, regardless of the fact that such connection is depicted.

As FIGS. 4 and 5 show, hair care device 1 can also have a plurality of ion outlets 11 on the back side of the device 8, wherein, in the embodiment depicted according to FIGS. 4 and 5, two ion outlets 11 are provided that, regarded in the longitudinal direction of the device, are situated at the same height and are positioned symmetrically to one another relative to longitudinal plane 18. Advantageously, ion outlets 11 are situated on the edge of the back side of the function head, wherein they are inclined to one another at an angle on the order of magnitude of 60° to 120°, preferably approximately 90°, in order to produce a uniformly distributed ion cloud. In the depicted embodiment, ion outlets 11 are oriented with their main exit direction 18 parallel to the surface of the back side of the device 8, so that the ions exit essentially parallel to the back side of the function head. In the depicted embodiment, ion outlets 11 cause the ions to exit in diverging directions in order to distribute an ion cloud uniformly over function head 4, or over the back side thereof.

Alternatively to the embodiment according to FIGS. 4 and 5, a plurality of ion outlets 11 can also be situated in longitudinal plane 18; cf. FIGS. 6 and 7. Advantageously, here the two ion outlets 11 are oriented opposite one another, wherein they are situated on opposite sides in edge areas of the back side of the function head (cf. FIGS. 6 and 7), in order to emit an ion cloud that arises over the back side of the function head.

Advantageously, the two ion outlets 11 can be inclined differently to the surface of the back side of the device. While the one ion outlet is oriented with its main exit direction 18 essentially parallel to the surface of the back side of the device 8, the other ion outlet 11 is inclined at a slightly acute angle to said surface of the back side of the device, preferably at an angle of 0° to 40°, in particular 10° to 30°. As FIGS. 6 and 7 show, here it can be particularly advantageous if ion outlet 11, situated in the transition area between handle 3 and function head 4, is slightly inclined, while ion outlet 11 situated at the end of the back side of the function head facing away from handle 3 can be situated parallel to the back side of the device 8.

As FIGS. 8 through 10 show, the above-named grounding device 20 advantageously also comprises a grounding surface 22 allocated to ion outlet 11. In particular, this grounding surface 22 is on an outer surface of outlet housing 13 that surrounds ion emitter 10 or its high-voltage element 12. As FIG. 8 best shows, the (roughly) box-shaped outlet housing 13 has an orifice side 14 that forms a front face, in which an exit opening 17 is provided for the exit of the emitted ions. High-voltage element 12 is situated centrally in outlet housing 13, and terminates shortly before said exit opening 17 inside outlet housing 13; cf. FIG. 10. High-voltage element 12 typically comprises a wire, or is made up of a wire, which as a rule is routed in an insulating sheath, while the outlet housing as a rule is made of another, third material, for example plastic (FIG. 10, which is schematic, does not make apparent differences in material).

In the embodiment according to FIGS. 8 through 10, a side surface 16 (which is peripheral relative to high-voltage element 12) is provided with grounding surface 22. According to FIGS. 8 through 10, this can be a bottom side of outlet housing 13, facing the main body of the device 2. Alternatively or in addition, this can also be a side wall surface 16 of outlet housing 13, as is shown in FIG. 12.

According to FIGS. 8 through 10, the entire bottom side of outlet housing 13 is fashioned as grounding surface 22, in particular as a metallic surface, wherein the remainder of the housing body can be fashioned so as to be nonconductive, in particular made of plastic. As FIG. 11 shows, the corresponding surface of outlet housing 13—in the case shown in FIG. 11, the bottom side surface—can also be provided with grounding surface 22 only in some segments; i.e., grounding surface 22 need not necessarily cover the entire side surface; cf. FIG. 11.

In the embodiment according to FIG. 12 as well, only approximately half of side surface 16 is fashioned as grounding surface 22.

As FIG. 13 shows, the back side of outlet housing 13, situated opposite orifice side 14, may also be fashioned as grounding surface 22.

Another embodiment is shown in FIG. 14. Here, side surfaces 16, situated opposite one another, of outlet housing 13 are each provided with a grounding surface 22, wherein, in the depicted embodiment, these are fashioned only as a strip that partly covers side surfaces 16.

FIG. 15 shows a hair care device 1 according to a further embodiment of the invention. To the extent that it is not described otherwise, this hair care device can correspond to the foregoing specific embodiments, wherein corresponding reference numerals in FIG. 15 are used for corresponding components. Essentially, the hair care device according to FIG. 15 differs from the previous embodiments in that the entire back side of the function head is grounded. Housing component 108, which forms the back of function head 4 and surrounds ion outlet 11, is itself made of a non-conductive material, in particular plastic, so that housing component 108 can itself become electrostatically charged. However, said housing component 108 is grounded via a contact to the ground potential of the high-voltage circuit, whereby electrostatic charging while not impossible, is sufficiently limited so that the electrical counter-fields resulting from charging are so small that they do not hinder the distribution of the ions from the ion outlet. Here, the electrical grounding can take place via an electrically contacted screw in a screw boss in housing component 108. Alternatively or in addition, a metallic electrode can be printed onto housing component 108, preferably on its inside. In both cases, a grounding surface connected to the ground potential is thus provided on housing component 108 in order to prevent or suppress the electrostatic charging of said housing component.

As FIG. 15 shows, grounded housing component 108 extends in the vicinity of ion outlet 11, essentially over the entire back surface of the body of the device, or the segment thereof over which the ion cloud exiting from ion outlet 11 disperses. Grounded housing component 108 extends, beginning from a back side of ion outlet 11 facing away from orifice side 14 of ion outlet 11, in particular over a large surface up to a point before ion outlet 11, i.e., downstream from said ion outlet 11, regarded in the exit direction of the ions from said ion outlet 11; cf. FIG. 15. Ion outlet 11 forms an island, so to speak, in the surface of grounded housing component 108, the larger part of housing component 108 (in the depicted embodiment, more than two-thirds of housing component 108) being situated on the exit side of ion outlet 11; cf. FIG. 15.

Said ion outlet 11 is integrated into said housing component 108; in particular, the latter has a dome-shaped curvature in order to create space for exit opening 17 of ion outlet 11, which in the depicted embodiment is formed by a sleeve 170, preferably made of plastic, that surrounds the ion emitter at the outlet side; cf. FIG. 15.

Instead of the full-surface grounding shown in FIG. 15 of the housing component in the exit area of ion emitter 10, it is possible, as shown in FIG. 16, to provide a plurality of separate housing components 108*a* and 108*b* in the vicinity of ion outlet 11, of which at least one is grounded while at least one other one is not grounded. The ungrounded parts can become electrostatically charged, causing the ions to be deflected. In contrast to this, over the grounded parts, the ions can propagate without impairment, so that an overall control of the ion cloud is achieved. In this way, the pattern of grounded and ungrounded housing components in the vicinity of ion outlet 11 forms an ion-guiding mechanism.

As FIG. 16 shows, this ion-guiding mechanism, or the pattern of grounded and ungrounded housing components 108*a* and 108*b*, can advantageously be situated or fashioned symmetrically to longitudinal plane 18 of hair care device 1. Specifically, FIG. 16 shows a central housing component 108*a* that extends away from ion outlet 11 in a trapezoidal shape, grounded in the manner described above. This central strip-shaped housing component 108*a* is flanked at the right and at the left by two lateral housing components 108*b* that remain ungrounded and thus can become electrostatically charged. In this exemplary embodiment, the ion-guiding mechanism forms an exit channel or corridor, as it were, that permits a directed ion emission and suppresses excessive lateral spreading. Depending on the application, however, other patterns of grounded or ungrounded housing components can be provided to achieve control of the dispersion of the ion cloud according to the particular application.

What is claimed is:

1. A hair treatment device having a handle (3), a function head (4) that can be connected to the handle (3) and that has a hair treatment device (5), and an ion-discharging device (9) for discharging ions onto the hair having two ion outlets (11), characterised in that the function head (4) and the handle each have an electrically conductive surface on the outside of a component, and the electrically conductive surface of the function head and the electrically conductive surface of the handle are connected to one another in electrically conductive fashion, and further characterized in that the two ion outlets (11) are both situated in an edge area of the back side of the function head (4), and facing each other, such that an ion cloud arising over the back side of the function head is produced.

* * * * *